United States Patent [19]

Howze

[11] Patent Number: 4,908,601

[45] Date of Patent: Mar. 13, 1990

[54] LOUD SPEAKER WITH HORIZONTAL RADIATION PATTERN

[75] Inventor: Bruce W. Howze, Springfield, Pa.

[73] Assignee: Whelen Technologies, Inc., Chester, Conn.

[21] Appl. No.: 78,101

[22] Filed: Jul. 27, 1987

[51] Int. Cl.[4] ..... G08B 3/00

[52] U.S. Cl. ..... 340/388; 181/192; 181/191; 181/188; 181/144; 181/152; 381/186; 381/195; 381/202; 381/193

[58] Field of Search ..... 340/388; 181/192, 191, 181/188, 144, 152, 159; 381/202, 182, 186, 188, 191, 193, 194, 195

[56] References Cited

U.S. PATENT DOCUMENTS

| | | | |
|---|---|---|---|
| 1,213,732 | 1/1917 | Bossu | 116/147 |
| 1,713,207 | 5/1929 | Yount et al. | 181/192 |
| 1,727,419 | 9/1929 | Volf Jr. | 186/192 |
| 1,777,283 | 10/1930 | Cosgrave | 116/147 |
| 1,943,499 | 1/1934 | Williams | 181/159 |
| 1,960,258 | 5/1934 | Williams | 340/405 |
| 1,970,926 | 8/1934 | Wente | 181/188 |
| 2,534,833 | 12/1950 | Seavey et al. | 340/825.62 |
| 2,638,510 | 5/1953 | Brami | 381/202 |
| 2,820,525 | 1/1958 | Fountain et al. | 340/388 |
| 2,935,575 | 5/1960 | Bobb | 381/182 |
| 3,153,783 | 10/1964 | Whitehead | 181/187 |
| 3,292,571 | 12/1966 | Watters | 116/137 |
| 3,477,540 | 11/1969 | Rizo-Patron | 181/144 |
| 3,649,776 | 3/1972 | Burton . | |
| 3,842,203 | 10/1974 | Weisberg | 381/182 |
| 4,088,847 | 5/1978 | Yukimoto et al. | 381/194 |
| 4,315,112 | 2/1982 | Hofer | 381/186 |
| 4,317,009 | 2/1982 | Shintaku | 381/194 |
| 4,529,969 | 7/1985 | Gosswiller | 116/147 |
| 4,591,672 | 5/1986 | Kato et al. | 381/193 |

FOREIGN PATENT DOCUMENTS

| | | | |
|---|---|---|---|
| 733450 | 2/1943 | Fed. Rep. of Germany . | |
| 459570 | 6/1913 | France . | |
| 0455208 | 10/1936 | United Kingdom | 381/186 |

OTHER PUBLICATIONS

Elektrotechnische Zeitschrift 8/8/34, vol. 32, p. 787.

*Primary Examiner*—Joseph A. Orsino
*Assistant Examiner*—Jill D. Jackson
*Attorney, Agent, or Firm*—Chilton, Alix & Van Kirk

[57] ABSTRACT

A siren having one or more stacked speakers, each speaker having a substantially circular lower horn member having an upwardly facing surface including a substantially convex annular portion and a substantially concave central cavity portion. A substantially circular upper horn member having a downwardly facing surface including a substantially convex annular outer portion and a central opening, is spaced above the lower horn member, thereby defining an annular, radially outwardly diverging sound director between the upper and lower horn members. A diffuser horn is coupled to a central opening in the upper horn member and projects downwardly into the cavity portion of the lower horn member. A siren driver is mounted in the upper horn member adjacent to the central opening for projecting a sound wave through the diffuser horn into the cavity, where the sound wave is reflected upwardly out of the cavity into the sound director, through which the sound is projected horizontally in a 360° pattern. A frame-like support system includes a plurality of vertical columns, each formed by connecting discrete support segments to one another, each support segment also being connected to an upper and a lower horn member. The siren driver includes a laminated, epoxied cloth for holding down the leads in intimate contact along the curvature or the diaphragm.

17 Claims, 5 Drawing Sheets

LOUD SPEAKER WITH HORIZONTAL RADIATION PATTERN

BACKGROUND OF THE INVENTION

The present invention relates to loud speakers having a generally horizontal 360° radiation pattern, and more particularly to loud speakers that can be vertically stacked for use as high powered sirens and the like.

High power loud speakers are known for use as sirens and horns to serve an alarm or warning function in environments such as navigation channels, fire stations, power plant perimeters, etc. Some of these loud speaker designs are also suitable for use in auditoriums or other large areas where communication to a large group of assembled persons is required. One type of known loud speaker arrangement for such use, has been commonly referred to as a "vertically stacked" siren or speaker system.

In one such arrangement, as disclosed in U.S. Pat. No. 3,153,783, a plurality of vertically stacked hyperbolic horns are arranged in spaced apart pods or envelopes, the space between the pods defining a sound director which disperses the sound horizontally in all directions. In the system disclosed in this patent, the profile of each envelope or pod completely surrounds the profile of an individual horn and associated driver.

Efforts have been made to increase the efficiency and/or reduce the cost of vertically stacked speaker arrangements. One example is disclosed in U.S. Pat. No. 2,820,525, in which a compound horn is oriented vertically upward from the bottom of the assembly and another compound horn is oriented vertically downward from the top of the assembly, each horn having associated with it a plurality of spaced apart pods. Sound transmitting channels from each portion of the horn lead to generally hyperbolic director surfaces between pods. Each channel has a different length based on the length of the portion of the horn to which it is connected, such that the total distance traveled by the sound wave from each portion of the composite horn, is substantially the same.

Although the examples of known loud speakers or siren systems identified above, and similar variations, are capable of producing high sound intensity, the need exists for improving the reliability, fabrication cost and operating efficiency involved in the manufacturer and use of this type of siren or loud speaker system.

SUMMARY OF THE INVENTION

It is thus an object of the present invention to improve the design and construction of known vertically stacked siren or speaker systems, thereby decreasing the manufacturing cost and increasing the power efficiency relative to known systems.

The foregoing and other objectives are accomplished with the present invention by utilizing one, or a plurality of, stacked speakers, each speaker having a substantially circular lower horn member having an upwardly facing surface including a substantially convex annular portion and a substantially concave central cavity portion. A substantially circular upper horn member, having a downwardly facing surface including a substantially convex annular outer portion and a central opening, is spaced above the lower horn member, thereby defining an annular, radially outwardly diverging sound director between the upper and lower horn members. A diffuser horn is coupled to a central opening, preferably by being integrally formed on the upper horn member, and projects downwardly into the cavity portion of the lower horn member. A siren driver is mounted in the upper horn member adjacent to the central opening for generating and subsequently projecting a sound wave through the diffuser horn into the cavity, where the sound wave is reflected upwardly out of the cavity into the sound director, through which the sound is projected horizontally in all directions. Each speaker of the type described is suitable as a stand alone unit, but if a system of higher sound level transmission capability is required, these individual speakers may be stacked, in modular fashion, one above the other. In accordance with another feature of the invention, the stacking is accomplished through the use of a novel frame-like support system in which a plurality of discrete support segments are each connected at its upper end to one horn member and, typically, to a first vertically aligned support segment. Each support segment is also connected at its lower end to one lower horn member and, possibly, to a second vertically aligned support segment.

When the stack of speakers is connected together in this fashion, a plurality of vertically spaced apart pods are formed. The space between adjacent pods functions as the horizontal sound director, and the connection between pods resulting from the connecting segments as described, provides a strong, rigid frame, which is easily assembled and facilitates repair or replacement of any of the components.

A further feature of the present invention is an improved siren driver in which the electrical connections between the movable voice coil and the external power supply terminals on the driver housing are accomplished through the use of lead wires which are intimately secured to the surface of the diaphragm by a piece of cloth saturated in epoxy. This makes the leads an integral part of the diaphragm suspension, so that they flex in a controlled manner, whereby the possibility of fatigue failure is greatly reduced.

BRIEF DESCRIPTION OF THE DRAWINGS

The above-discussed and other features and advantages of the preferred embodiment of the invention will be described in greater detail below with reference to the accompanying drawings, in which.

DESCRIPTION OF THE PREFERRED EMBODIMENT

Figure 1:
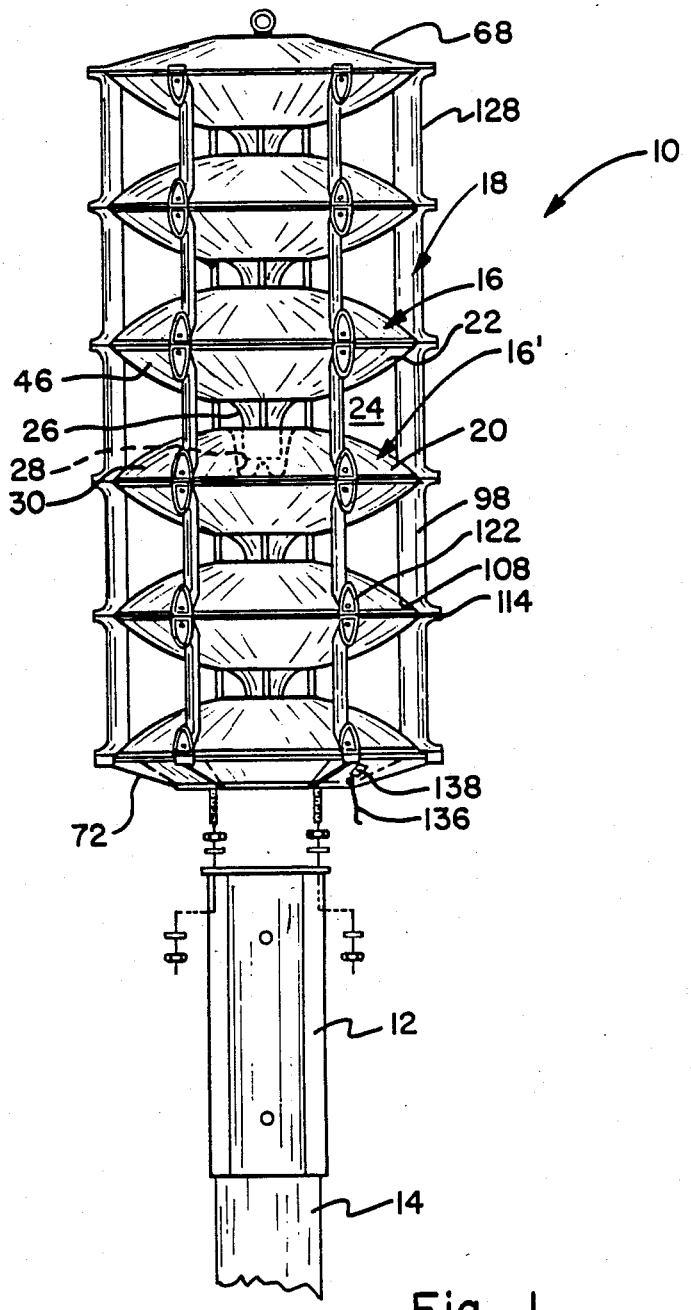
FIG. 1 is an elevation view of a siren system in accordance with the invention which employs plural vertically stacked speakers.

A vertically stacked siren or loud speaker assembly 10 in accordance with the present invention is shown in FIG. 1. The siren is shown mounted on a pole bracket 12 which in turn is secured to a pole 14 or similar mounting surface. In outward appearance, the siren includes a plurality of vertically spaced apart pods 16 held rigidly together by a frame 18. The upper and lower surfaces of adjacent pods, respectively indicated at 20 and 22, define a sound director 24 in which the sound originating in the horn 26 of a given pod is projected downwardly against the wall of a cavity 28 in the upper surface of the lower pod, where it is reflected upwardly and enters the director region 24 and is radiated horizontally in a 360° pattern. A horn 26 is provided for each pod define sound director region 24, the horns spanning the space between adjacent pods 16, 16'.

Figure 2:
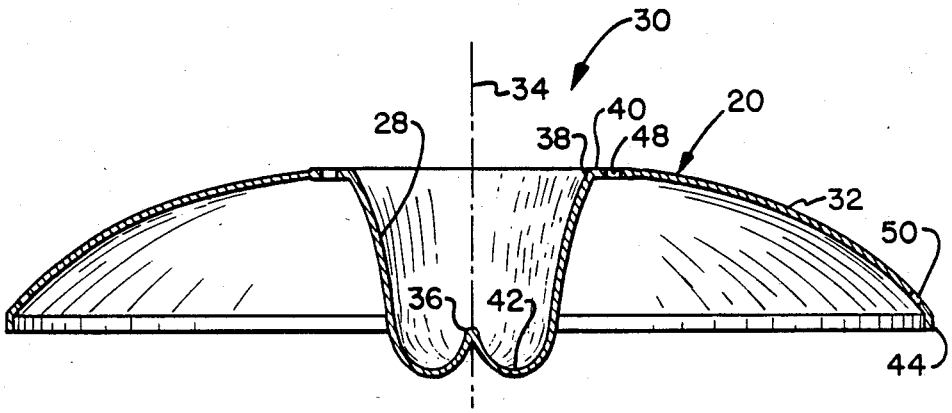
FIG. 2 is a section view, taken along line 2—2 of FIG. 1, showing the contour of the upper surface of the lower speaker horn member.

FIG. 2 is a section view of the speaker lower horn member 30 which defines an upper surface 20 of a pod. The lower horn member 30 has the general shape of an inverted bowl with an upwardly facing surface 20 which includes a convex, substantially hyperbolic, annular outer portion 32 and a substantially concave, inner cavity portion 28. The inner cavity portion 28 preferably presents a solid surface for receiving and reflecting the sound projected from the drive horn (not shown). The speaker lower member 30 is preferably circular and rotationally symmetric about its center 34.

The cavity portion 28 preferably includes a cusp 36 along the center line, located well below the outer portion 32 of the member, with the inner wall of the cavity forming a smooth, substantially W-shaped bowl when viewed in section. The upper extent 38 of the inner walls of the bowl are joined smoothly to the inner extent 40 of the outer portion 32 of the member. Preferably, the inner walls of the cavity 28 diverge continuously from the cusp 36 to their juncture with the outer portion 32 of the member.

In the illustrated embodiment, the deepest point 42 of the cavity 28 is at a level below the circumferential edge 44 of the member 30, and the cusp 36 is approximately coplanar with the circumferential edge 44. As will be described below in connection with FIGS. 3 and 4, a mating speaker upper horn member 46 , which defines the lower portion of an adjacent pod 16, will be connected at its circumferential edge with the lower member 30 described above. Sufficient space must be left along the vertical center line of the pod, below the cavity, to permit the mounting of a horn driver. A pair of members 30 and 46 will be assembled to form a pod 16.

Also shown in FIG. 2, for purposes to be explained below, are a plurality of annularly arranged, substantial vertical inner holes 48, and a plurality of annularly arranged, outer holes 50 near the circumferential edge 44 of the member 30.

Figure 3:
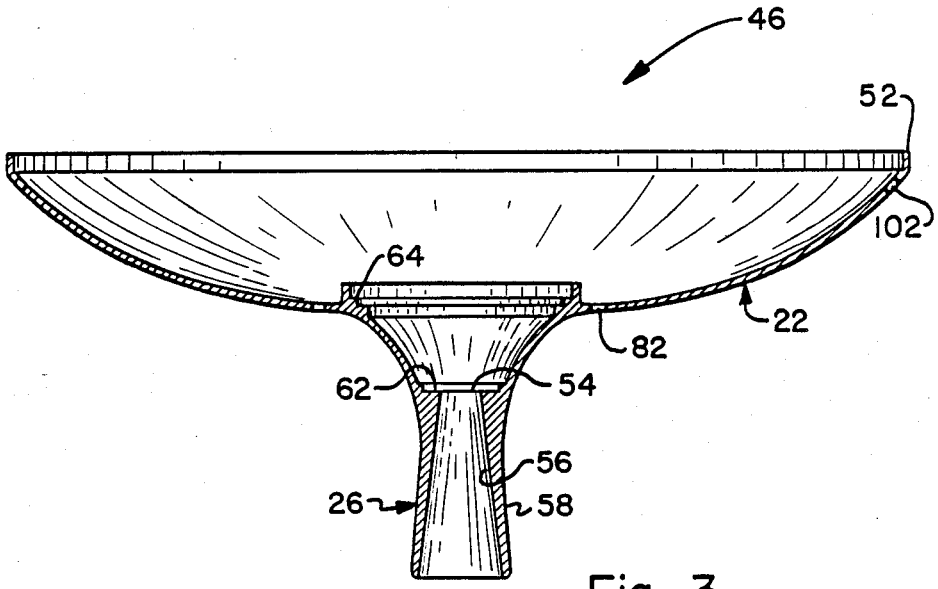
FIG. 3 is a section view, taken along line 3—3 of FIG. 1, showing the contour of the lower surface of the upper speaker horn member.

FIG. 3 is a sectional view of the speaker upper horn member 46 associated with the lower horn member 30 shown in FIG. 2, which together define the director 24 associated with given driver and horn.

The upper horn member 46 is generally bowl-shaped, having a circular outer edge 52 and a rotationally symmetric convex lower surface 22 which is hyperbolic about the annular outer portion and which converges toward a central opening 54. The opening 54 is adapted for mounting a horn driver in a vertically downward orientation. The driver requires an associated diffuser which, in the preferred embodiment, is provided by an integral, hollow projection 58, as a downward continuation of the smooth lower surface 22 of the member 46. The diffuser projection 58 preferably has a substantially cylindrical mounting surface 62 leading into diverging diffuser chamber 56. Other internal mounting shoulders 64 for supporting the driver (not shown) may also be desirable. Member 46 is provided with a pattern of assembly holes 82, 102 which matches the pattern of holes 48, 50 in member 30.

As shown in FIG. 1, when the pods 16 have been assembled, the diffuser projection 58 of an upper speaker horn member 46 projects into the cavity 28 of the associated lower speaker horn member 30, the diffuser horn 26 terminating above the bottom surface of the cavity. Member 46 is provided with a pattern of assembly holes 80, 102 which matches the pattern of holes 48, 50 in member 30. Thus, sound waves projected through the diffuser horn 58 are reflected upwardly from the cavity walls back into the director region 24 and radiated horizontally from the siren 10. Each set of diffuser 26, cavity 28, and horn members 30, 46 define a single acoustical unit, i.e., an exponential horn. The spacing of these parts thus is dictated by the desired continuity of the exponential shape.

Figure 4:
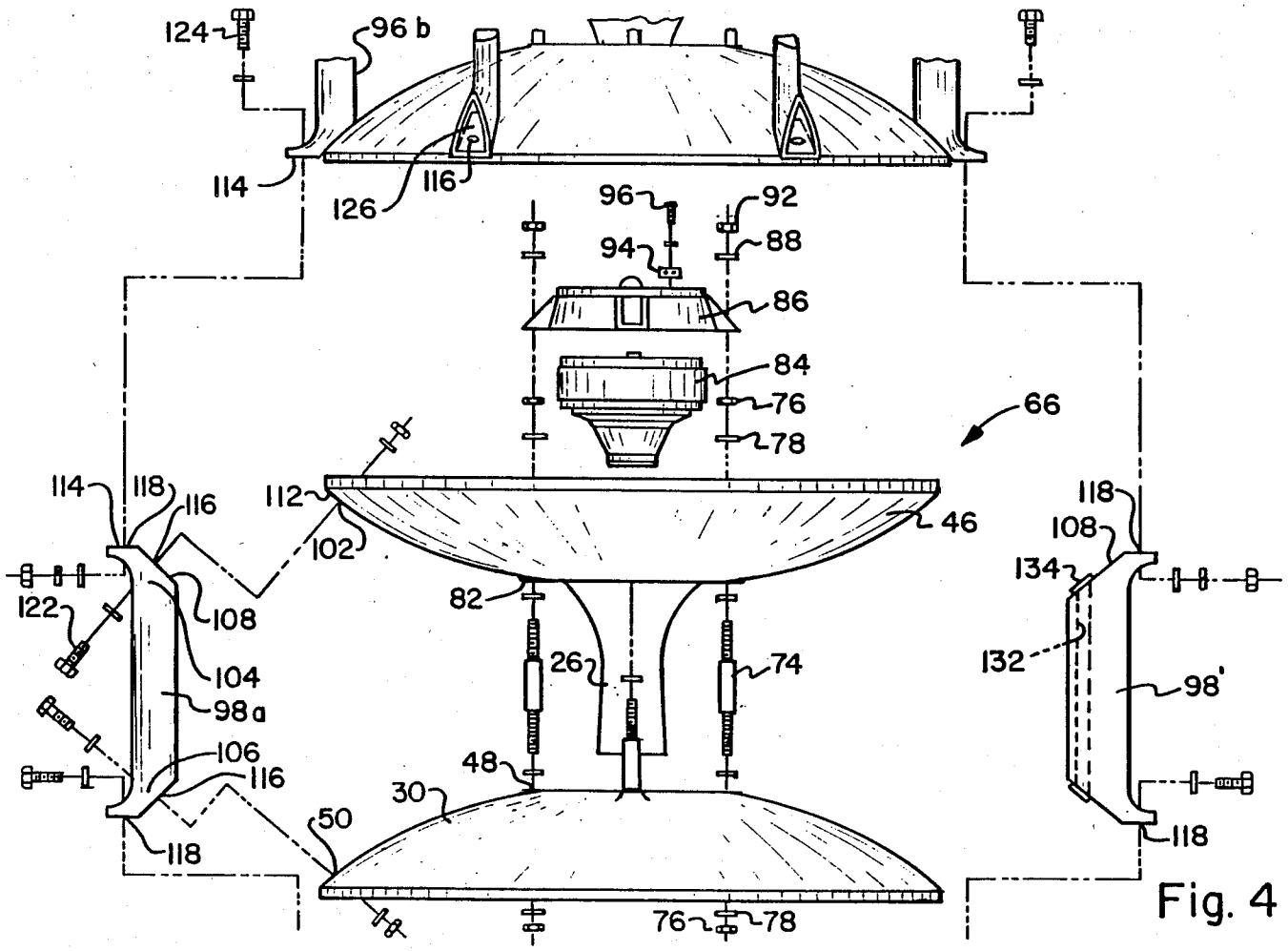
FIG. 4 is an exploded assembly view of an upper speaker horn and adjacent lower speaker horn, with the associated connection brackets and driver.

FIG. 4 shows in greater detail, the construction of a single horn and director unit 66, which can provide a suitable siren or loud speaker if relatively low sound intensity is required.

If used alone, the single horn and director unit 66 shown in FIG. 4 would be fitted with a saucer-shaped cover 68 and base 72 as shown in FIG. 1, thereby creating the appearance of a two pod stack.

As shown in FIGS. 1 and 4, in the disaligned embodiment a plurality of spacer bolts 74 and associated nuts 76 and lock washers 78 serve to space the immediately adjacent upper 46 and lower 30 speaker horn members according to a predetermined relationship, thereby defining an annular, radially outwardly diverging sound director 24 between the upper and lower horn members. The inner holes 48, 82 are used for this purpose. A siren driver 84 is mounted adjacent the diffuser horn 26 within the speaker upper horn member 46, as shown in FIG. 3. A driver cover 86 is located over the driver and, by means of the washers 88 and nuts 92, is secured to the threaded upper ends of the spacer bolts 74. The insulated electrical terminals 94 for the driver, are secured to the cover by means of machine screws 96 or the like. The speaker lower horn member 30 is, in a similar manner, secured by washers 78 and nuts 76 to the lower threaded ends of the spacer bolts 74.

A plurality of support segments 98, preferrably comprised of cast aluminum, are connected to the upper and lower speaker horn members 30, 46 at the locations of the outer ring annular holes 50, 102 shown in FIGS. 2 and 3. The segments 98 are aerodynamically shaped to minimize distortion and losses. Thus when viewed in the plane and direction of radiation, the segments 98 are vertically oriented airfoils.

These support segments preferably serve two functions simultaneously. First, they connect an individual speaker lower horn member 30 along its circumference 44 to the abutting edge 52 of an individual speaker upper horn member 46, to form an individual pod 16. The support segments 98 also rigidly connect a speaker lower horn member 30 with its cooperating, spaced apart speaker upper horn member 46 and thus define the sound director 24. In a siren having only a single driver and associated director, only a single row or array of, typically, six segments 98 are needed, the cover 68 and base 72 being attachable to the upper 104 and lower 106 end tabs, respectively, of the segments.

When the siren is configured, in modular fashion, into a stacked siren as shown in FIG. 1, several rows, or arrays of segments 98 are utilized to form the rigid frame 18 that can withstand severe environmental forces due to winds, rain, and the like. Each discrete support segment 98*a* is connected at its upper end 104 to one upper horn member 46 and with the exception of the uppermost segment, to a second segment 98*b*. Similarly, each support segment 98*a* is connected at its lower end 106 to one lower horn member 30 and, with the exception of the lowermost segment, to a third segment 98*c* (not shown on FIG. 4). Each segment tab 104, 106 is preferably symmetrical, and includes inclined inner surface 108 facing the curved surface 112 on a horn member and a substantially horizontal end surface 114 facing a similar end surface 114 on one of the neighboring second or third segments 98*b*, 98*c* (not shown).

The inclined surface 108 and end surface 114 respectively have holes 116, 118 which are aligned with holes 50, 102, and 118 in the horn members and other segments, respectively, through which fasteners 122, 124 are secured to rigidly connect the segments to the horn members, and the segments to each other.

Preferably, each end tab 104, 106 has a boot-like profile, and a substantially triangular, hollow interior 126 open at the side through which the fasteners 122, 124 are installed The body portion of the segment 98 between tabs 104, 106, can be solid.

Particularly with the stacked siren arrangement shown in FIG. 1, one of the columns 128 of vertically aligned support segments 98 consists of segments 98, which have an enclosed channel or passage 132 extending between openings 134 on the inclined surfaces 108. These openings 134 mate with respective openings 50, 102 near the outer edges of the speaker upper and lower horn members, but fastening means are not inserted therethrough. Rather, the channels 132, when properly aligned and secured by means of the fastening of the segments end to end through holes 118, provide a continuous, protected path for the electrical cabling 136 needed by the individual, spaced apart drivers mounted in each pod.

Referring again to FIG. 1, an access plate 138 with associated seal and fastening means may be provided in the base member 72, or, if desired, through the lower surface 22 of each of the pods 16.

It should be appreciated that the siren construction described above consists of easily fabricated components which can be fastened together to provide a rugged, reliable siren. Moreover, the modularity of each of the pods permits the fabrication of sirens having a wide range of potential intensities, merely by stacking together an appropriate number of pods, each having the same size, engagement and mounting surfaces, and fastening structures. The efficiency and performance of the siren described herein is also superior to that available from known devices in that its horizontal dispersion is perfectly uniform at all frequencies over a full 360° coverage area, thus providing uniform siren and voice capability over the designated coverage area. Typical prior horn systems used for this purpose are arrays of directional horns, and these systems have regions of cancellation between individual horns that result in ragged, non-uniform coverage patterns and significantly degraded performance.

Figure 5:
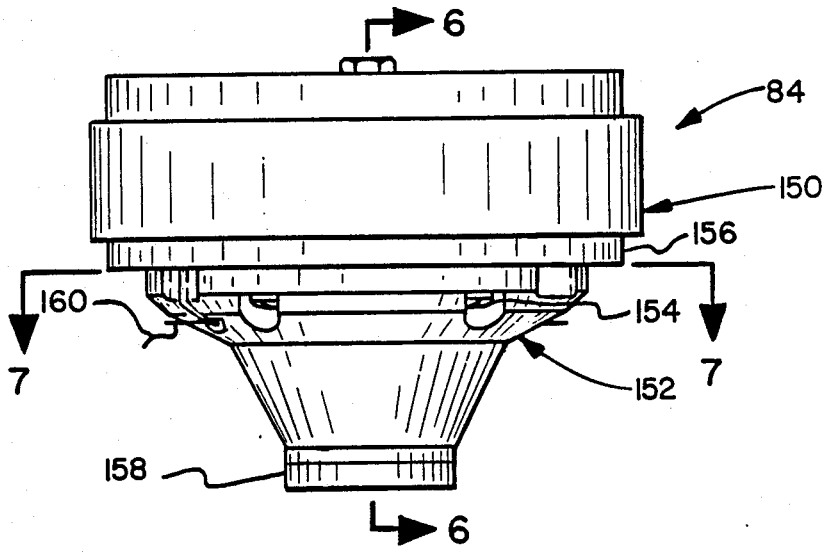
FIG. 5 is an elevation view of the preferred siren driver construction for use with a speaker unit in accordance with the present invention.
Figure 6:
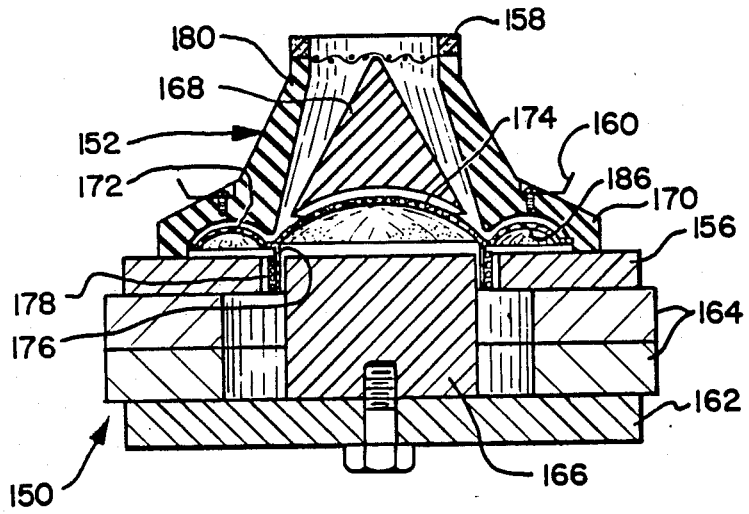
FIG. 6 is a section view of the construction, taken along line 6—6 of FIG. 5.
Figure 7:
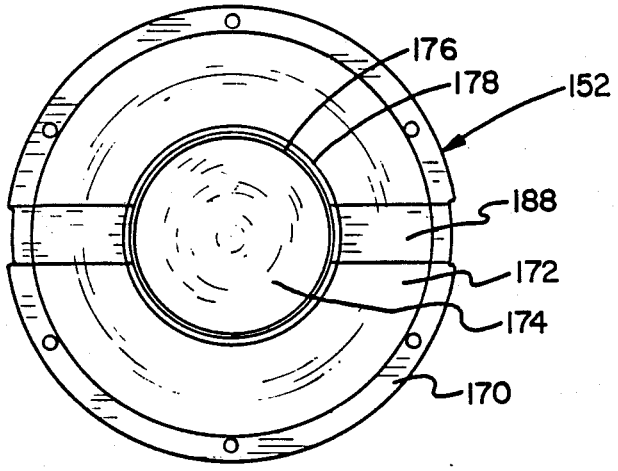
FIG. 7 is a section view of the driver, taken along line 7—7 of FIG. 6.

FIGS. 5–7 show the preferred construction of the siren driver assembly 84, which is adapted to fit into the shoulders 62, 64 in the upper speaker horn member 46, as shown in FIG. 3.

As shown in FIG. 5, the driver assembly includes a magnet structure 150 and a phase plug assembly 152, which are connected together by bolts 154. The magnet structure top plate 156 forms a mounting shoulder which mates with the corresponding shoulder 64 in the upper horn member, and the phase plug assembly 152 has an annular rubber gasket 158 for mating with a corresponding mounting shoulder 62 in the upper horn member (see FIG. 3). Electrical terminals 160 penetrate the phase plug assembly to energize the voice coil contained therein.

FIGS. 6 and 7 show the inner structures associated with the inventive features of the present invention. The magnet structure 150 includes a steel back plate 162, dual ceramic magnet slugs 164, a steel pole piece 166 and a steel top plate 156. The phase plug assembly 152 is in the form of a generally conical outer shell 180 and a second concentric conical inner core 168. The outer shell 180 includes an outer suspension rim 170 which supports the diaphragm suspension 172, the diaphragm central dome 174 and the cylindrical voice coil form 176 centered between the diaphragm suspension and central dome.

The coil form 176 includes a portion which projects into the annular gap between top plate 156 and pole piece 166 of magnet structure 150. The driver voice coil is wound on form 176, as indicated schematically at 178. As is well known in this field, the permanent magnet establishes an intense radial field in the annular gap between the top plate and pole piece. The moving voice coil is attached to the light, stiff diaphragm 172, 174 and thus is supported by a flexible suspension which keeps the diaphragm and coil in place while permitting its axial motion. Upon application of an alternating current to the voice coil, a varying magnetic field is generated and, due to the interaction of this field with the field produced by the permanent magnet, a force which is transmitted to the diaphragm is developed. The diaphragm is thus caused to move and produces air pressure waves whereby accoustic energy is radiated through the exit aperture in the housing 152.

A persistent problem in the operation of high intensity loud speaker drivers of the type described above has been the vulnerability to metal fatigue failure of the electrical connections between the coil 178 and the terminals 160. In accordance with the invention, the coil 178 is connected to the terminals 160 by leads 186 that are laminated to the diaphragm with a piece of cloth 188 saturated in epoxy. This makes the leads 186 an integral part of the diaphragm suspension, forcing them to flex in a controlled manner and greatly reducing fatigue failure of the leads.

The laminated leads can pass between the suspension rim 170 and the housing frame 162 and follow the external surface of the rim 170, where they are affixed to the terminals 160.

In a given driver, a plurality of leads may be employed, and these leads will be arranged substantially radially, in parallel, from the coil form toward the rim portion of the housing. Preferably, the laminated connection of the leads to the contour of the diaphragm, extends continuously from the diaphragm radially along the housing rim to an exterior surface where the leads are electrically secured to respective terminals.

While a preferred embodiment has been shown and described, various modifications and substitutions may be made thereto without departing fro the spirit and scope of the invention. Accordingly, it is to be understood that the present invention has been described by way of illustration and not limitation.

I claim:

1. A speaker comprising:

a substantially circular speaker lower horn member having an upwardly facing surface which includes a substantially convex annular portion and a substantially concave central cavity portion, said lower horn member having a central axis;

a substantially circular upper horn member having a downwardly facing surface which includes a substantially convex outer portion and a central opening, said upper horn member having a central axis;

means for spacing the upper horn member coaxially with and immediately above the lower horn member to thereby define an annular, radially outwardly diverging sound director between the upper and lower horn members, said sound director being substantially symmetrical relative to a plane which is generally transverse to the axis of said horn members, said plane intersecting said axis at a point intermediate said spaced lower and upper horn members;

diffuser means coupled to the central opening of the upper horn member and extending downwardly through said plane into the cavity portion of the lower horn member; and driver means mounted in the upper horn member and coupled to the diffuser means for projecting sound through the diffuser means into the cavity portion of the lower horn member, the sound being reflected upwardly out of the cavity into the sound director whereby the sound is projected in a 360° pattern.

2. The speaker of claim 1 wherein the central cavity forms a solid surface.

3. A siren having a plurality of speakers as recited in claim 1, comprising means for connecting said speakers together to form a vertically stacked siren and for connecting each individual speaker lower horn member along its circumference to an abrutting individual speaker upper horn member, to form a plurality of individual pods.

4. A speaker comprising:

a substantially circular speaker lower horn member having a central axis and an upwardly facing surface which includes a substantially convex annular portion and a substantially concave central cavity portion, said central cavity portion defining a solid surface which is rotationally symmetric about the central axis of the lower horn member, said solid surface including a cusp which is coaxial with the lower horn member, said cusp being located below the level of said lower horn member annular portion and having inner walls forming a smooth, substantially W-shaped bowl when viewed in section;

a substantially circular speaker upper horn member having a central axis and a downwardly facing surface which includes a substantially convex annular outer portion and a central opening;

means for spacing the upper horn member coaxially with and immediately above the lower horn member to thereby define an annular, radially outwardly diverging sound director between the upper and lower horn members;

diffuser means coupled to the central opening of the upper horn member and extending downwardly into the cavity portion of the lower horn member, said diffuser means being coaxial with said horn members; and driver means mounted in the upper horn member and coupled to the diffuser means for projecting sound through the diffuser means into the cavity portion of lower horn member, the sound being reflected upwardly out of the said lower member cavity portion into the sound director whereby the sound is projected in a 360° pattern.

5. The speaker of claim 4 wherein the W-shaped inner walls diverge continuously from the cusp.

6. The speaker of claim 4, wherein the diffuser means is integrally formed as a central continuation of said annular portion of the surface of the upper horn member.

7. A siren having a plurality of speakers as recited in claim 4, comprising means for connecting said speakers together to form a vertically stacked siren and for connecting each individual speaker lower horn member along its circumference to an abutting individual speaker upper horn member, to form a plurality of individual spaced apart pods.

8. The speaker of claim 4, wherein the diffuser means is integrally formed as a central continuation of said annular portion of the surface of the upper horn member.

9. A siren having a plurality of speakers as recited in claim 8, comprising means for connecting said speakers together to form a vertically stacked siren and for connecting each individual speaker lower horn member along its circumference to an abutting individual speaker upper horn member, to form a plurality of individual spaced apart pods.

10. A siren comprising:

a plurality of speakers, each of said speakers including:

a substantially circular speaker lower horn member having a central axis and an upwardly facing surface which includes a substantially convex annular portion and a substantially concave central cavity portion;

a substantially circular speaker upper horn member having a central axis and a downwardly facing surface which includes a substantially convex annular outer portion and a central opening;

means for spacing the upper horn member coaxially with and immediately above the lower horn member to thereby define an annular, radially outwardly diverging sound director between the upper and lower horn members;

diffuser means coupled to the central opening of the upper horn member and extending downwardly into the cavity portion of the lower horn member; and driver means mounted in the upper horn member and coupled to the diffuser means for projecting sound through the diffuser means into the cavity portion of the lower horn member, the sound being reflected upwardly out of the cavity into the sound director whereby the sound is projected in a 360° pattern; and means for connecting said speakers together to form a vertical stack of speakers, said connecting means mechanically joining each individual speaker lower horn member along its circumference to an abutting individual speaker upper horn member to thereby define a plurality of individual pods, said connecting means including a plurality of discrete support segments, each segment being connected at its upper end to one upper horn member and to a first vertically aligned segment, each segment being connected at its lower end to one lower horn member and to a second vertically aligned segment.

11. The siren of claim 10 wherein each segment has symmetrical upper and lower connector tabs, each connector tab including an inclined surface facing a speaker horn member and a substantially horizontal end surface facing a similar end surface on one of said first or second aligned segments.

12. The siren of claim 10 wherein each speaker horn member and each inclined surface on each segment, has aligned holes through which fasteners rigidly connect the segments to the horn members.

13. The siren of claim 10 wherein the end surfaces of each segment connector have aligned holes through which fasteners rigidly connect the segments vertically to each other.

14. The siren of claim 13 wherein one of the segments associated with each pod has a vertical channel aligned with a vertical channel on an adjacent vertical segments, and wherein an electrical cable traverses the siren through said channel.

15. A siren having a plurality of speakers, each of said speakers including:

substantially circular speaker lower horn member having a central axis and an upwardly facing surface which includes a substantially convex annular portion and a substantially concave central cavity portion, said central cavity portion defining a solid surface;

a substantially circular speaker upper horn member having a central axis and a downwardly facing surface which includes a substantially convex annular outer portion and a central opening;

means for spacing the upper horn member coaxially with and immediately above the lower horn member to thereby define an annular, radially outwardly diverging sound director between the upper and lower horn members;

diffuser means coupled to the central opening of the upper horn member and extending downwardly into the cavity portion of the lower horn member; and driver means mounted in the upper horn member and coupled to the diffuser means for projecting sound through the diffuser means into the cavity portion of the lower horn member, the sound being reflected upwardly out of the cavity into the sound director whereby the sound is projected in a 360° pattern;

the siren further comprising:

means for connecting said speakers together to form a vertical stack, said connecting means joining each individual speaker lower horn member along its circumferential to an abutting individual speaker horn member to thereby define a plurality of individual spaced apart pods.

16. A speaker comprising:

a substantially circular lower horn member having a central axis and an upwardly facing surface which includes a substantially convex annular portion and a substantially concave central cavity portion;

a substantially circular upper horn member having central axis and a downwardly facing surface which includes a substantially convex annular outer portion and a central opening;

means for spacing the upper horn member coaxially with and immediately above the lower horn member to thereby define an annular, radially outwardly diverging sound director between the upper and lower horn members;

diffuser means coupled to the central opening of the upper horn member and extending coaxially of said horn members downwardly into the cavity portion of the lower horn members; and driver means mounted in the upper horn member and coupled to the diffuser means for projecting sound through the diffuser means into the cavity portion of the lower horn member, the sound being reflected upwardly out of the cavity portion into the sound director whereby the sound is projected in a 360° pattern, the driver means including:

coil housing means, said housing means having a rim;

a coil form suspended coaxially within said housing means rim;

a flexible diaphragm connected between said coil form and said rim;

a voice coil carried by said form;

a least a first electrical terminal supported on said housing means and;

an electrical lead connected between said coil and said terminal, said lead being laminated to the said diaphragm with a piece of fabric.

17. In a loud speaker driver having a housing including a rim portion, a coil form centered within the rim portion, a coil carried by the form, electrical terminals supported on the exterior of the housing, and a flexible diaphragm connecting the coil form to the rim, the improvement comprising:

electrical leads extending between the coil and respective of said terminals, said leads being bonded to the diaphragm by a piece of cloth saturated in epoxy whereby the leads will be an intimate contact with the surface of the diaphragm and will flex therewith during energization of the driver, said leads further being laminated to said rim portion between the diaphragm and the terminals.

* * * * *